United States Patent [19]

Houska

[11] 4,141,943

[45] Feb. 27, 1979

[54] METHOD OF MANUFACTURING PLASTIC-BONDED (LNCO) MAGNETS

[75] Inventor: Jaroslav Houska, Niederrohrdorf, Switzerland

[73] Assignee: BBC Brown, Boveri & Company, Limited, Baden, Switzerland

[21] Appl. No.: 835,061

[22] Filed: Sep. 21, 1977

[30] Foreign Application Priority Data

Oct. 4, 1976 [CH] Switzerland ..... 12539/76

[51] Int. Cl.[2] ..... H01F 1/08

[52] U.S. Cl. ..... 264/24; 148/31.57; 252/62.55; 264/65; 264/134

[58] Field of Search ..... 264/61, 63, 65, DIG. 58, 264/24; 252/62.54, 62.55; 148/31.57, 134

[56] References Cited

U.S. PATENT DOCUMENTS

| | | | |
|---|---|---|---|
| 3,074,888 | 1/1963 | Carter | 264/61 |
| 3,371,044 | 2/1968 | Cochardt | 264/61 |
| 3,421,889 | 1/1969 | Ostertag et al. | 252/62.55 |
| 3,723,587 | 3/1973 | Iwase et al. | 264/61 |
| 3,839,102 | 10/1974 | Tawara et al. | 148/31.57 |
| 4,003,767 | 1/1977 | Bachmann et al. | 148/31.57 |
| 4,087,291 | 5/1978 | Garffi et al. | 148/31.57 |

*Primary Examiner*—Robert F. White
*Assistant Examiner*—John A. Parrish
*Attorney, Agent, or Firm*—Oblon, Fisher, Spivak, McClelland & Maier

[57] ABSTRACT

The invention concerns a method of manufacturing plastic - bonded (LnCo) magnets (Ln = lanthanoid = elements 57 - 71 + yttrium), pulverization of the (LnCo) material being followed by alignment of the magnetic powder by a magnetic field, a compression process and curing of the added plastic.

12 Claims, No Drawings

METHOD OF MANUFACTURING PLASTIC-BONDED (LNCO) MAGNETS

Plastic-bonded (LnCo) magnets are well known and have been commercially available for some time (see also Brown, Boveri Review, vol. 62, 5 (1975), p. 212). These magnets are manufactured in the following sequence:

mixing of magnetic powder with plastic powder,
alignment of the magnetic powder by a magnetic field,
pressing,
curing of the plastic.

The product is an anisotropic, already partially or fully magnetised plastic-bonded magnet. Owing to the magnetisation already present, it is almost impossible in practice to achieve multipolar magnetisation when a close pole spacing and uniform magnetisation of both poles is required. The main problem with these magnets, however, is ageing, particulary at slightly elevated temperatures (~100° C.); see in this respect "Paper No. 1-3 at the Second International Workshop on Rare-Earth Cobalt Permanent Magnets and their Applications," June 8-11, 1976.

The object of the invention is to avoid the disadvantages of the known method and to create a new method that allows the manufacture of plastic-bonded (LnCo) magnets which with regard especially to their magnetic properties are much more stable than the products obtainable on the market, and furthermore embody other advantages to be discussed in the following. This object is achieved in that in the manufacturing process with a method of the kind described above, before the magnetic powder is aligned in the magnetic field the (LnCo) material is first ground to a particle size of 1-100μ, then after alignment of the magnetic powder in the magnetic field the powder is pressed under a pressure p = 1000-10,000 kp/cm$^2$, and the green body thus abtained is then subjected to heat treatment above the Curie temperature up to a maximum of 1150° C. in a protective atmosphere for 1-20 h, the resulting body is then infiltrated with plastic in a vacuum of approx. 1-30 Torr at a temperature of approx. 20°-80° C., and the body thus infiltrated is then pressed with a pressure of 2-2000 kp/cm$^2$, and in that after curing of the plastic and the final machining the magnet is magnetised under the influence of a magnetic field.

Low-viscosity epoxy resin is suitable as the plastic. Thermal demagnetisation of the magnets by heating above the Curie temperature $T_c$, which is the outstanding feature of the invention, is preferably carried out at temperatures of 800°-950° C.

The plastic-bonded magnets manufactured by the method of the invention are, as mentioned above, at first completely non-magnetic after heat treatment. This complete demagnetisation of the magnets is an essential prerequisite if the magnets are to be multipolar with closely spaced poles and at the same time uniformly strong magnetisation of the two poles is necessary. As already stated, it has also been found that magnets manufactured according to the method of the invention are much more stable than the known commercially available plastic magnets; they also exhibit a high energy product of 80 kJ/m$^3$ (10 MGOe). The demagnetisation curves are virtually linear over the second quadrant. The new magnets are amenable to machining by chip-removal techniques and are not brittle. Their magnetic properties are comparable with those of (PtCo) magnets, but the raw material costs of plastic-bonded magnets are significantly lower.

It is of advantage if the magnetic alloy employed with the method is $LnCo_5$ with 35-37% by weight of Ln, of which at least 50% by weight is Sm. Favourable results are also obtained with an alloy of Ln $(Co_{1-y}Cu_y)_Z$, where y and Z are preferably so chosen that $0<y\leqq 0.3$ and $6\leqq Z\leqq 8.5$. Other preferred variants are Sm $Co_5$ and $Sm_{0.7}MM_{0.3}Co_5$, where MM denotes a mixture of lanthanoid series element consisting mainly of Nd (~17%).

EXAMPLE OF MANUFACTURE

A magnetic alloy $LnCo_5$, with 35-37% by weight Ln, of which at least 70% by weight is Sm, the remainder as desired, is ground to a particle size of 3-10 mm. The powder is then aligned in a magnetic field of at least 0.5 T (5 kG) and then compressed at a pressure p = 2000-8000 kp/cm$^2$. The green body thus obtained is then heat treated in accordance with the invention for 1-20 hours at 800°-950° C. under a protective atmosphere of He or Ar, and subsequently infiltrated with low-viscosity epoxy resin in a vacuum of 1-30 Torr at a temperature of 20°-80° C. The infiltrated body is then pressed again with a pressure of 2-2000 kp/cm$^2$. The plastic is then cured for 2-4 hours at 20°-140° C., and the resulting plastic-bonded body is machined to the desired shape. Finally, the body is magnetised in a magnetic field of at least 1.5 T (15kG).

The magnetic properties of plastic-bonded magnets are greatly improved through the method of the invention. The magnetic values $_IH_c$ (coexcive field) and $H_k$ (knee field) can be doubled, thus also significantly reducing the irreversible losses at elevated magnet operating temperatures.

What we claim is:

1. A method of manufacturing a plastic-bonded LnCo magnet having improved stability at temperatures around 100° C., high energy product, essentially linear demagnetization curves over the second quadrant, and uniform magnetization of the poles, where Ln = elements 57 to 71 and yttrium, which comprises the steps of forming a green body by aligning a powdered magnetic LnCo alloy having a particle size of from 1 to 100 microns in a magnetic field, and then pressing said powder under a pressure of from 1,000 to 10,000 kp/cm$^2$;

subjecting said green body to a heat treatment above its Curie temperature up to a maximum of 1150° C. in a protective atmosphere for from 1 to 20 hours, such that the resultant heat-treated body is completely demagnetized;

impregnating said resultant heat-treated body with plastic in a vacuum of from about 1 to about 30 Torr. at a temperature of from about 20° to about 80° C.;

pressing the resultant impregnated body at a pressure of from 2 to 2,000 kp/cm$^2$;

curing the resultant pressed, impregnated body, and machining to final form; and magnetizing said cured body under the influence of a magnetic field to produce said plastic-bonded LnCo magnet.

2. The method of claim 1, in which said particle size is 3-10μ.

3. The method of claim 1, in which the temperature employed in said heat treatment is 800–950° C.

4. The method of claim 1, in which said magnetic alloy is $LnCo_5$ with 35–37% by weight of Ln, of which at least 50% by weight is Sm.

5. The method of claim 1, in which said magnetic LnCo alloy is $Ln(Co_{1-y}Cu_y)_z$, where $0<y\leqq 0.3$ and $6\leqq z\leqq 8.5$.

6. The method of claim 1, in which said magnetic alloy is $Sm_{0.7}MM_{0.3}Co_5$.

7. The method of claim 1, in which said plastic is low-viscosity epoxy resin.

8. The method of claim 1, wherein said plastic-bonded LnCo magnet is a multipolar magnet with closely spaced poles.

9. The method of claim 1, wherein said protective atmosphere is selected from the group consisting of helium and argon.

10. The method of claim 1, wherein said powdered magnetic LnCo alloy is aligned in a magnetic field of at least 5 kG.

11. The method of claim 1, wherein said pressed, impregnated body is cured for from 2 to 4 hours at from 20° to 140° C.

12. The method of claim 1, wherein said cured body is magnetized in a magnetic field of at least 15 kG.

* * * * *